US012352516B2

(12) United States Patent
Jonsson

(10) Patent No.: US 12,352,516 B2
(45) Date of Patent: Jul. 8, 2025

(54) UPPER RECEIVER WITH BOLT BIASING MEMBER

(71) Applicant: Manticore Arms, Inc., North Charleston, SC (US)

(72) Inventor: Sven Jonsson, Goose Creek, SC (US)

(73) Assignee: Sven Jonsson, Goose Creek, SC (US)

( * ) Notice: Subject to any disclaimer, the term of this patent is extended or adjusted under 35 U.S.C. 154(b) by 0 days.

(21) Appl. No.: 18/735,067

(22) Filed: Jun. 5, 2024

(65) Prior Publication Data

US 2025/0027732 A1 Jan. 23, 2025

Related U.S. Application Data

(60) Provisional application No. 63/513,993, filed on Jul. 17, 2023.

(51) Int. Cl.
*F41A 3/78* (2006.01)
*F41A 3/66* (2006.01)

(52) U.S. Cl.
CPC . *F41A 3/78* (2013.01); *F41A 3/66* (2013.01)

(58) Field of Classification Search
CPC ..... F41A 3/46; F41A 3/44; F41A 3/56; F41A 3/66
USPC ..... 89/199, 198
See application file for complete search history.

(56) References Cited

U.S. PATENT DOCUMENTS 7,299,737 B2 * 11/2007 Hajjar ..... F41A 3/46 89/188
10,816,287 B1 * 10/2020 Russo ..... F41A 3/46
11,781,824 B2 * 10/2023 Underwood ..... F41A 3/46 89/194

* cited by examiner

*Primary Examiner* — Reginald S Tillman, Jr.

(57) ABSTRACT

A firearm is disclosed. The firearm can include an upper receiver that includes a bolt. The bolt can include at least one displaceable biasing member that is configured to bias the bolt in a forward state when the at least one biasing member is in an initial state. The bolt can also include a locking wedge that is configured to bias the at least one displaceable biasing member in the initial state. The at least one displaceable biasing member is configured to be displaced from the initial state to a displaced state when a sufficient amount of force is exerted on the at least one displaceable biasing member from the bolt so that the bolt can transition from the forward state to a backward state.

20 Claims, 9 Drawing Sheets

UPPER RECEIVER WITH BOLT BIASING MEMBER

BACKGROUND

Once a conventional AR-15 type firearm is fired, gas is funneled to a bolt carrier in response to firing of a cartridge. As a result, the bolt carrier is transitioned from a forward position to a backward position to allow ejection of the fired cartridge casing. The resulting bolt carrier transition can manifest itself as a force experienced by the firearm user commonly known as recoil.

SUMMARY

A firearm can include an upper receiver that includes a bolt. The bolt can include at least one displaceable biasing member that is configured to bias the bolt in a forward state when the at least one biasing member is in an initial state. The bolt can also include a locking wedge that is configured to bias the at least one displaceable biasing member in the initial state. The at least one displaceable biasing member is configured to be displaced from the initial state to a displaced state when a sufficient amount of force is exerted on the at least one displaceable biasing member from the bolt so that the bolt can transition from the forward state to a backward state.

In other implementations, the at least one displaceable biasing member comprises a roller.

In other implementations, the upper receiver is configured as an upper receiver for an AR-15 type firearm.

In other implementations, the at least one displaceable biasing member is designed in a shape of a truncated prolate spheroid.

In other implementations, the at least one displaceable biasing member defines a convex shaped curve that at least substantially matches a bore of the upper receiver portion.

In other implementations, the locking wedge defines a locking wedge angle that allows the at least one displaceable biasing member to be displaced based on a sufficient amount of force being exerted on the bolt.

In other implementations, the firearm can include a buffer, wherein the locking wedge interfaces with the buffer such that the buffer is displacement when the bolt transitions from the forward state to the backward state.

In other implementations, the firearm can include a buffer spring, wherein the buffer spring bias the buffer in a forward position when the buffer spring is in a non-compressed state.

In other implementations, the firearm can include a buffer actuator that is configured to remove a locking force of at least one of the locking wedge or the at least one displaceable biasing member when a sufficient amount of force translates the buffer actuator from a first position to a second position.

In other implementations, the buffer actuator comprises a biasing member that biases the buffer actuator in the first position when the biasing member is in a non-compressed state. In other implementations, the biasing member comprises a spring.

A firearm can include an upper receiver including a bolt. The bolt can include at least one displaceable biasing member that is configured to bias the bolt in a forward state when the at least one biasing member is in an initial state. The bolt can also include a locking wedge that is configured to bias the at least one displaceable biasing member in the initial state and a buffer that interfaces with the locking wedge. The at least one displaceable biasing member is configured to be displaced from the initial state to a displaced state when a sufficient amount of force is exerted on the at least one displaceable biasing member from the bolt so that the bolt can transition from the forward state to a backward state, where displacement of the bolt causes displacement of the buffer via the locking wedge.

In other implementations, the at least one displaceable biasing member comprises a roller.

In other implementations, the upper receiver is configured as an upper receiver for an AR-15 type firearm.

In other implementations, the at least one displaceable biasing member is designed in a shape of a truncated prolate spheroid.

In other implementations, the at least one displaceable biasing member defines a convex shaped curve that at least substantially matches a bore of the upper receiver portion.

In other implementations, the locking wedge defines a locking wedge angle that allows the at least one displaceable biasing member to be displaced based on a sufficient amount of force being exerted on the bolt.

In other implementations, the firearm includes a buffer spring, where the buffer spring bias the buffer in a forward position when the buffer spring is in a non-compressed state.

In other implementations, the firearm includes a buffer actuator that is configured to remove a locking force of at least one of the locking wedge or the at least one displaceable biasing member when a sufficient amount of force translates the buffer actuator from a first position to a second position.

In other implementations, the buffer actuator comprises a biasing member that biases the buffer actuator in the first position when the biasing member is in a non-compressed state.

DETAILED DESCRIPTION

Figure 1A:
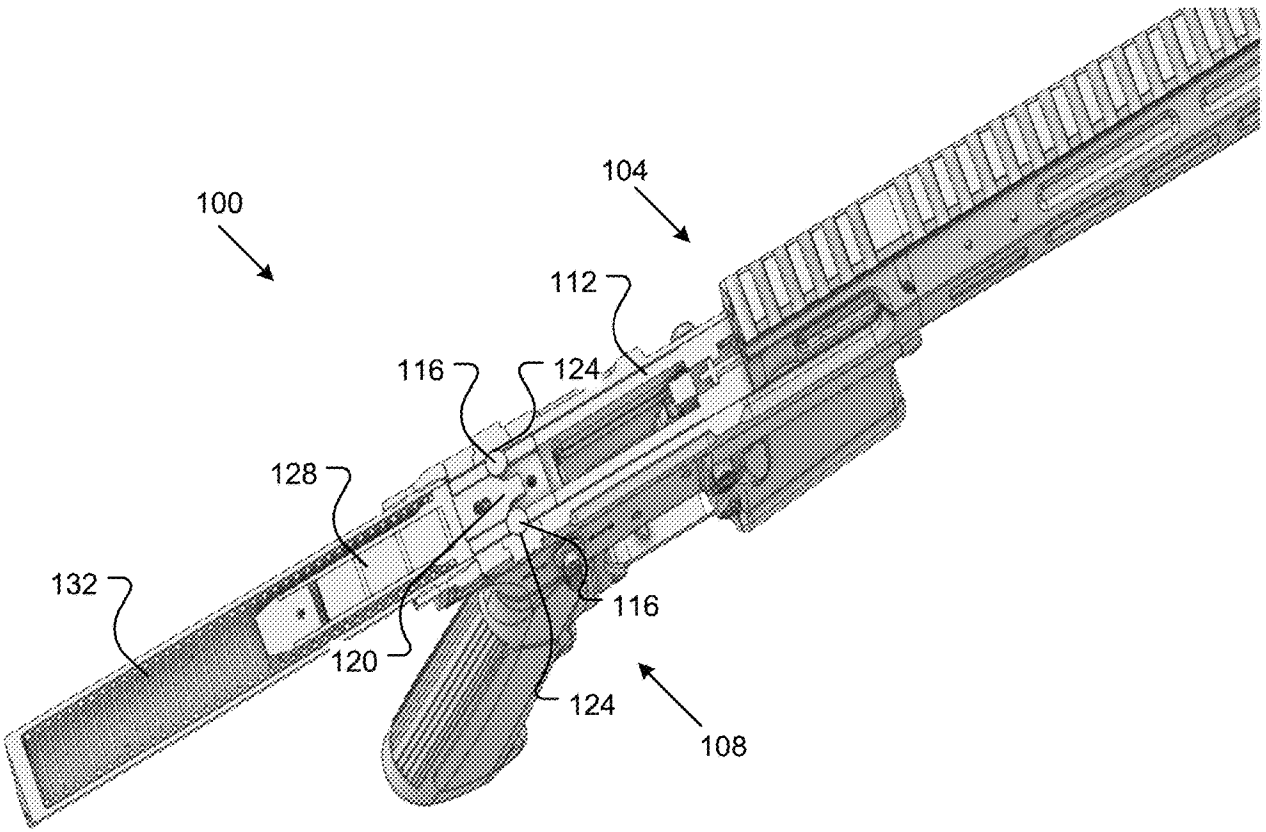
FIG. 1A is an isometric partial cutaway view of a firearm that includes an upper receiver having a displaceable bolt biasing member according to an example implementation of the present disclosure.
Figure 1B:
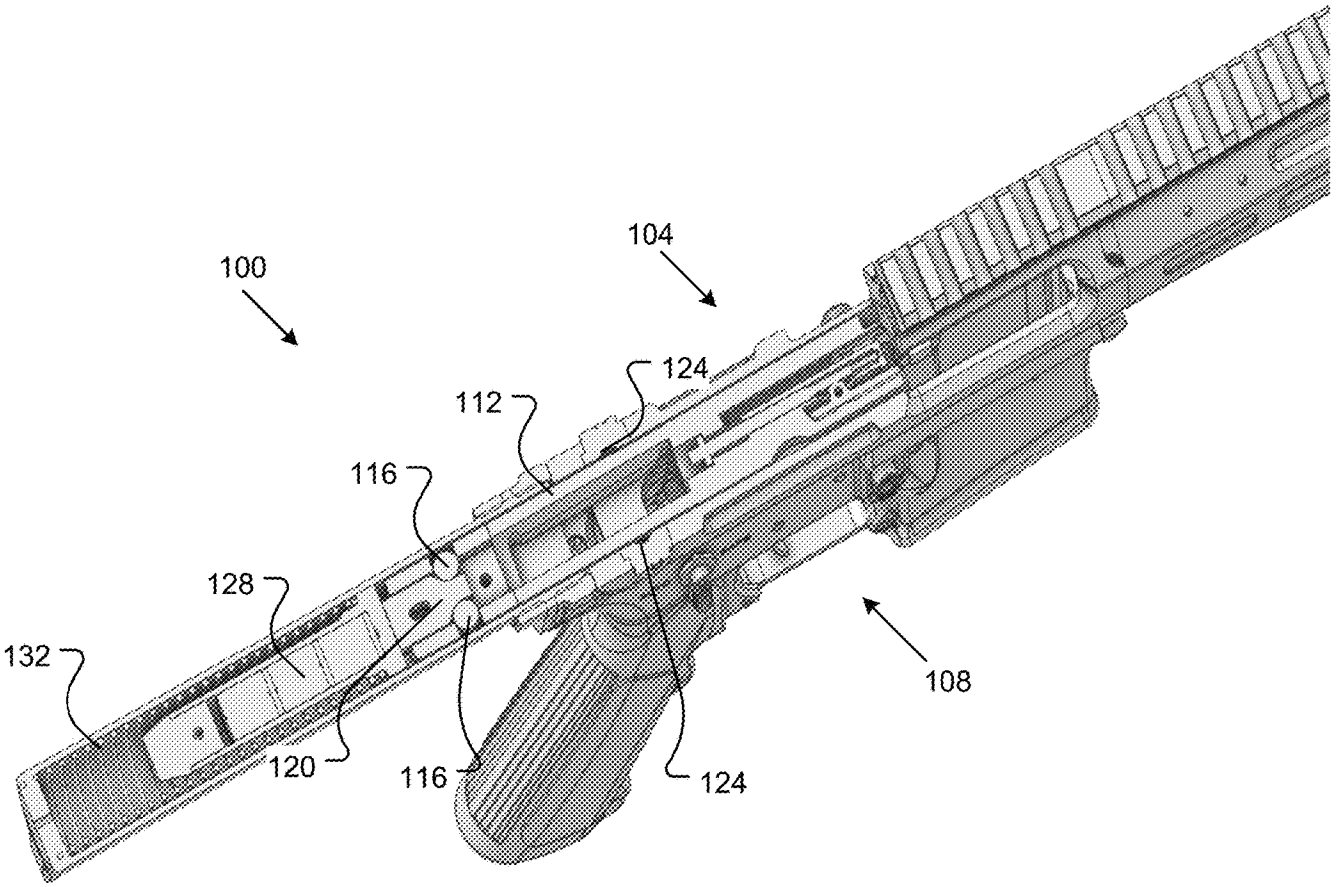
FIG. 1B is another isometric partial cutaway view of the firearm that includes an upper receiver having a displaceable bolt biasing member according to an example implementation of the present disclosure.
Figure 1C:
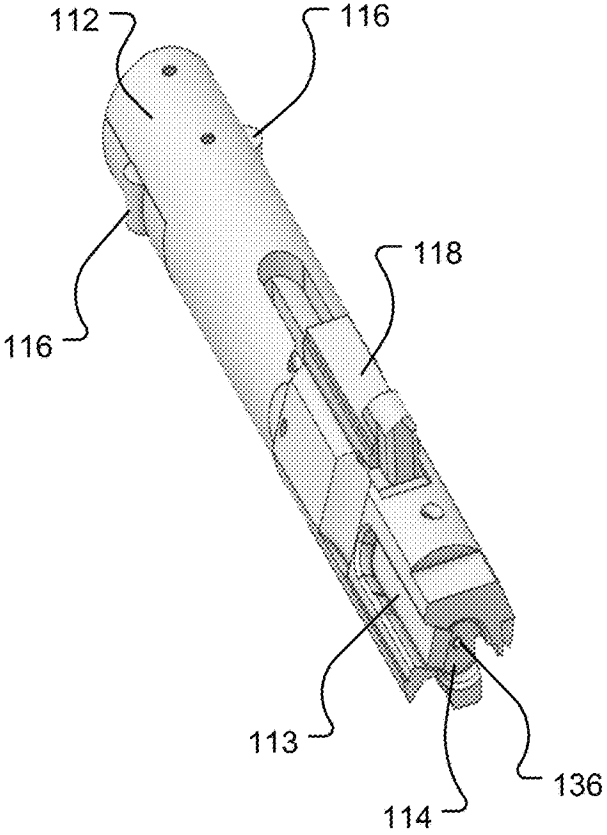
FIG. 1C is an isometric view of a bolt according to an example implementation of the present disclosure.
Figure 1D:
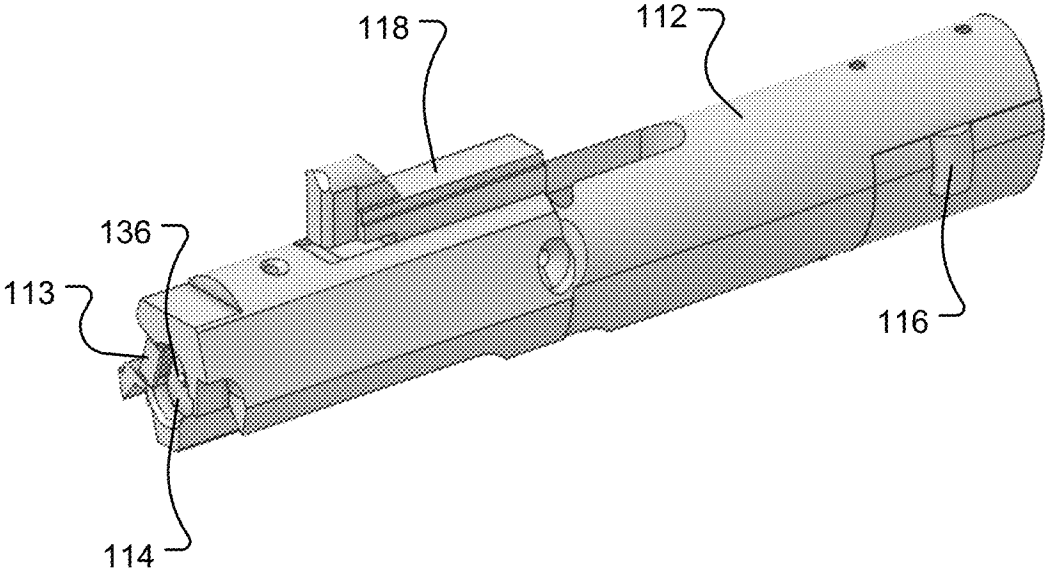
FIG. 1D is another isometric view of the bolt according to an example implementation of the present disclosure.
Figure 1E:
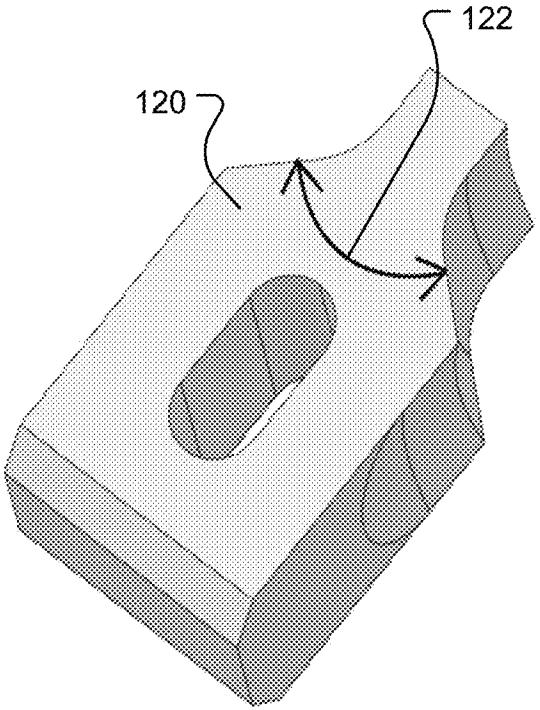
FIG. 1E is an isometric view of a locking wedge according to an example implementation of the present disclosure.

FIGS. 1A through 2D illustrates an example firearm 100 according to the present disclosure. In various implementations, the firearm 100 can comprise an AR-15 type firearm. Furthermore, in various implementations, the firearm 100 can comprise a pistol caliber AR-15 type firearm.

As shown, the firearm 100 includes an upper receiver portion 104 and a lower receiver portion 108. Within the present context, the lower receiver portion 108 comprises a conventional lower receiver, e.g., a stock lower receiver.

With reference to the upper receiver portion 104, the upper receiver portion 104 includes a bolt 112. The bolt 112 is configured to fire and eject cartridges when the firearm 100 is fired. As shown, the bolt 112 can include an extractor claw 113, a bolt face 114, one or more displaceable biasing members 116, a bolt key 118, a locking wedge 120, and one or more recesses 124. The one or more displaceable biasing members 116 may comprise rollers in an example implementation. In one or more example implementations, the rollers, i.e., displaceable biasing members 116, may be designed in the shape of a cylinder. In another example implementation, the rollers, i.e., displaceable biasing members 116, may be designed in the shape of a truncated prolate spheroid, i.e., barrel shaped. In this implementation, the rollers define a convex shaped curve that at least substantially matches a bore of the upper receiver portion 104. For instance, a radius of the displaceable biasing member 116 and corresponding locking recesses at least substantially match a radius of a cylinder of the bore that the bolt slides in. It is understood that within the present disclosure, the bolt 112 can encompass members typically referred to as a bolt carrier key and bolt. As shown, the upper receiver portion 104 can also include a buffer 128 and a recoil spring 132.

The locking wedge 120 biases the displaceable biasing members 116 in an initial state such that the one or more displaceable biasing members 116 bias the bolt 112 in a forward state. After a firing pin 136 (see FIGS. 1C and 1D) engages with a cartridge, the cartridge detonates and the resulting explosion and expanding gas exerts a force on the bolt 112 to transition the bolt 112 from the forward state to a backward state in which a cartridge casing can be ejected. The force exerted on the bolt 112 by the gas causes the bolt 112 to displace the one or more displaceable biasing members 116 from the initial state to a displaced state (see FIG. 1B).

As discussed above, the locking wedge 120 is configured to bias the displaceable biasing members 116 in an initial state. However, the locking wedge 120 comprises a locking wedge angle 122 (see FIG. 1E) that can allow the displaceable biasing members 116 to be displaced as a function of the force exerted on the bolt 112. It is understood that one can control the amount of force required to displace the displaceable biasing members 116 based on the locking wedge angle 122. For instance, in some implementations, a locking wedge angle 122 can be selected that would at least substantially prevent the bolt 112 from displacing the displaceable biasing members 116, i.e., the displaceable biasing members 116 would stay in the initial state. Reducing the locking wedge angle 122 increases the amount of time and force required to move the displaceable biasing members 116, and thus the bolt 112 from the initial state to the displaced state. Thus, if a cartridge has more energy, a reduced locking wedge angle 122 can be used to increase the amount of time the bolt 112 is held in the initial state to allow pressure in the cartridge and barrel to drop to a safe level for the extraction of the case to occur.

The locking wedge 120 interfaces with a buffer 128, and the buffer 128 is biased in a forward position by the recoil spring 132, i.e., a buffer spring. As the bolt 112 displaces the displaceable biasing members 116 from the initial state to the displaced state, the locking wedge 120 exerts a force on the buffer 128 that causes the buffer 128 to transition from the forward position to a backward position. In other words, the locking wedge 120 exerts a sufficient force on the buffer 128 that causes the buffer 128 to displace the recoil spring 132 causing the recoil spring 132 to move from a non-compressed state to a compressed state.

In various implementations, the locking wedge 120 can define a convex shaped pocket to mitigate wear and deformation on the bore as the bolt 112 slides between a first position and a second position.

Eventually, as a result of gas exiting the firearm 100, the recoil spring 132 exerts a force on the buffer 128 to cause the buffer 128 to transition from the backward position to the forward position. Similarly, the locking wedge 120 is displaced along with the buffer 128 causing the displaceable biasing members 116 to transition from the displaced state to the initial state to bias the bolt 112 in the forward state.

Referring to FIGS. 2A through 2D, the upper receiver portion 104 of the firearm 100 includes a translatable buffer actuator 202. In this implementation, the translatable buffer actuator 202 can replace the bolt key 118 within the upper receiver portion 104. The translatable buffer actuator 202 can transition, e.g., slide, between a first position, i.e., resting or non-displaced position, and a second position, i.e., displaced position. The buffer actuator 202 defines one or more slots 206 that allow translation of the buffer actuator 202 between the first position and the second position. The upper receiver portion 104 includes one or more retaining bolts 210 positioned within the slots 206 to limit movement of the buffer actuator 202.

Figure 2A:
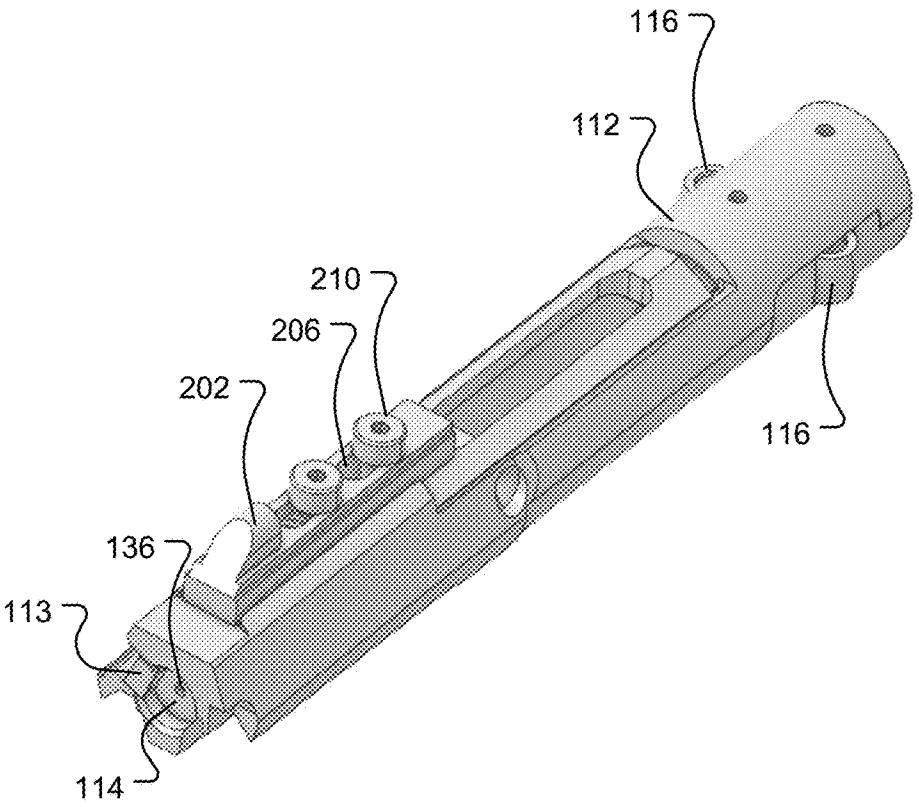
FIG. 2A is an isometric view of a bolt according to another example implementation of the present disclosure.
Figure 2B:
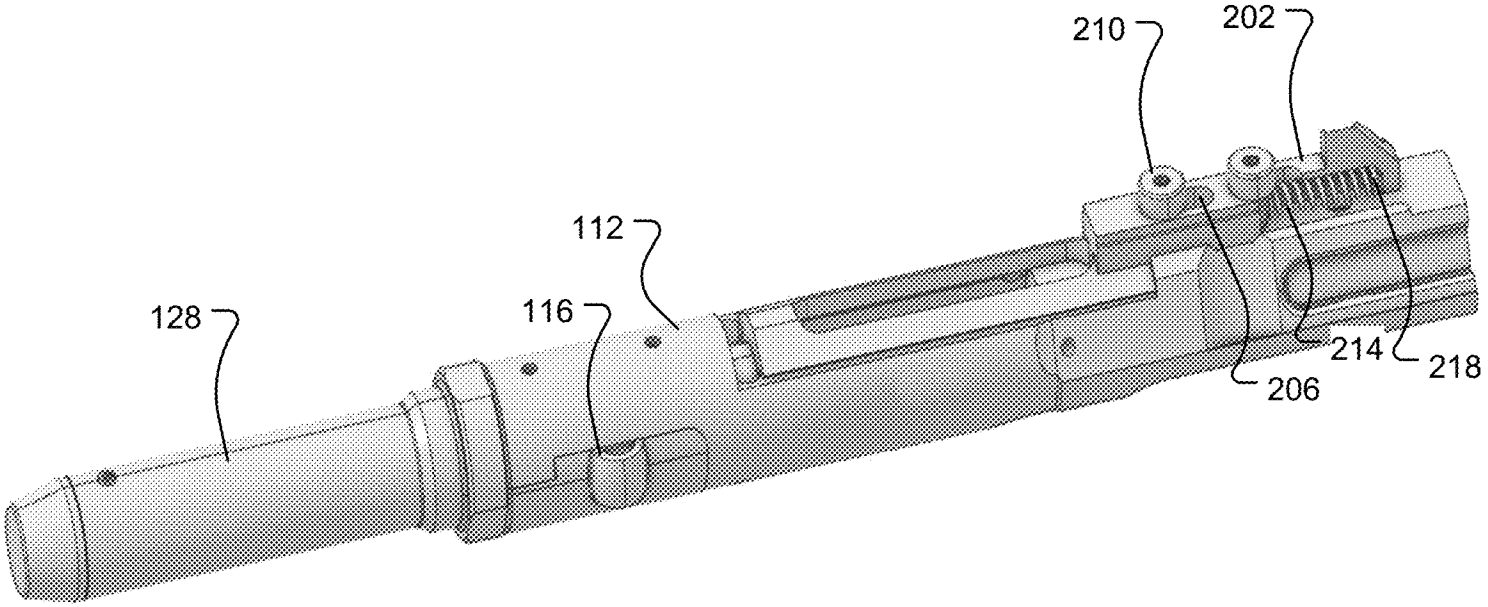
FIG. 2B is another isometric view of a bolt according to an example implementation of the present disclosure.

Referring to FIG. 2B, the buffer actuator 202 defines a cavity 214 that includes a biasing member 218 that exerts a biasing force on the buffer actuator 202 to maintain the buffer actuator 202 in the first position until a sufficient amount of force causes the buffer actuator 202 to transition to the second position. For instance, the biasing member 218 is configured to urge the buffer actuator 202 toward a muzzle of the firearm 100 when the biasing member 218 is in a non-compressed state. In an example implementation, the biasing member 218 comprises a return spring.

Figure 2C:
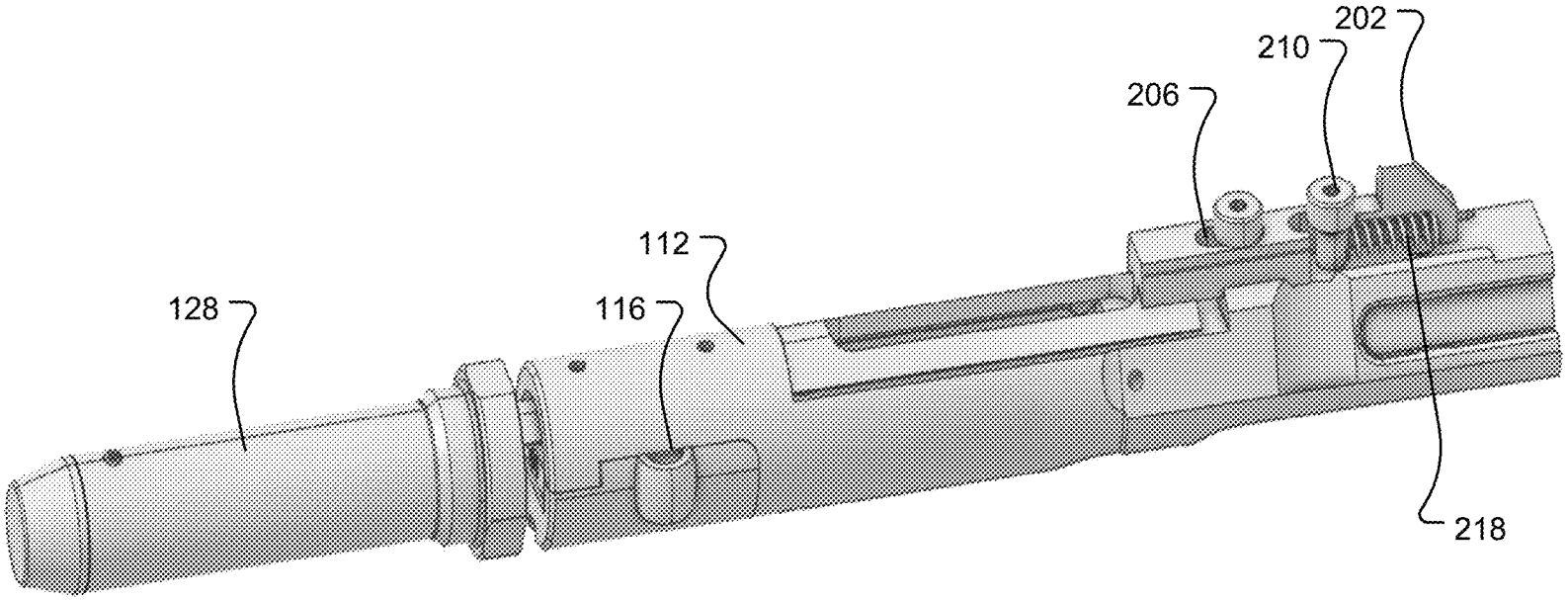
FIG. 2C is another isometric view of a bolt according to an example implementation of the present disclosure.
Figure 2D:
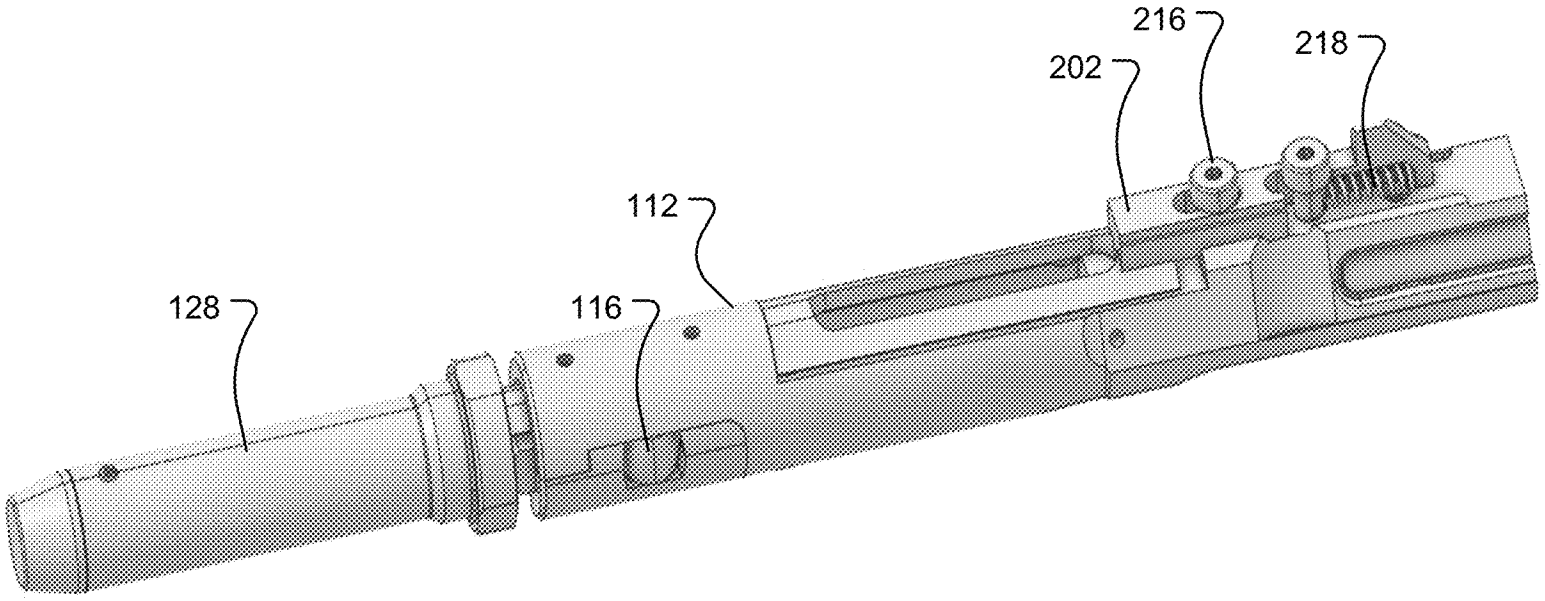
FIG. 2D is another isometric view of a bolt according to an example implementation of the present disclosure.

With reference to FIGS. 2C and 2D, when a sufficient amount of force is exerted on the buffer actuator 202, the buffer actuator 202 is urged from the first position to the second position. For example, a charging handle may be actuated by a user such that the charging handle bears on the buffer actuator 202. Movement of the buffer actuator 202 to the second position causes the buffer 128 to move rearward and removes force maintaining the locking wedge 120 and bolt biasing members 116 in the initial state. As the buffer 128 is transitioned to the backward position by the charging handle, the biasing member(s) 116 transitions from the initial state to the displaced state as discussed in a similar manner as above (see FIG. 2D). The buffer actuator 202 allows operation of the charging handle to remove the locking force of the locking wedge 120 and biasing member(s) 116 from the bolt 102, thus allowing the locking forces caused by the locking wedge 120 and biasing member(s) 116 to be bypassed when manually charging the firearm 100 and only the force of the buffer spring 132 providing resistance, while during firing the locking wedge 120 and biasing member(s) 116 still provide additional locking force.

The foregoing disclosure provides illustration and description, but is not intended to be exhaustive or to limit the implementations to the precise form disclosed. Modifications and variations are possible in light of the above disclosure or may be acquired from practice of the implementations.

Even though particular combinations of features are recited in the claims and/or disclosed in the specification, these combinations are not intended to limit the disclosure of possible implementations. In fact, many of these features may be combined in ways not specifically recited in the claims and/or disclosed in the specification. Although each dependent claim listed below may directly depend on only one claim, the disclosure of possible implementations includes each dependent claim in combination with every other claim in the claim set.

No element, act, or instruction used herein should be construed as critical or essential unless explicitly described as such. Also, as used herein, the articles "a" and "an" are intended to include one or more items, and may be used interchangeably with "one or more." Furthermore, as used herein, the term "set" is intended to include one or more items (e.g., related items, unrelated items, a combination of related and unrelated items, etc.), and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. A firearm comprising:

an upper receiver including a bolt, the bolt including:

at least one displaceable biasing member that is configured to bias the bolt in a forward state when the at least one biasing member is in an initial state; and a locking wedge that is configured to bias the at least one displaceable biasing member in the initial state, wherein the at least one displaceable biasing member is configured to be displaced from the initial state to a displaced state when a sufficient amount of force is exerted on the at least one displaceable biasing member from the bolt so that the bolt can transition from the forward state to a backward state.

2. The firearm as recited in claim 1, wherein the at least one displaceable biasing member comprises a roller.

3. The firearm as recited in claim 1, wherein the upper receiver is configured as an upper receiver for an AR-15 type firearm.

4. The firearm as recited in claim 1, wherein the at least one displaceable biasing member is designed in a shape of a truncated prolate spheroid.

5. The firearm as recited in claim 4, wherein the at least one displaceable biasing member defines a convex shaped curve that at least substantially matches a bore of the upper receiver portion.

6. The firearm as recited in claim 1, wherein the locking wedge defines a locking wedge angle that allows the at least one displaceable biasing member to be displaced based on a sufficient amount of force being exerted on the bolt.

7. The firearm as recited in claim 1, further comprising a buffer, wherein the locking wedge interfaces with the buffer such that the buffer is displacement when the bolt transitions from the forward state to the backward state.

8. The firearm as recited in claim 7, further comprising a buffer spring, wherein the buffer spring bias the buffer in a forward position when the buffer spring is in a non-compressed state.

9. The firearm as recited in claim 8, further comprising a buffer actuator that is configured to remove a locking force of at least one of the locking wedge or the at least one displaceable biasing member when a sufficient amount of force translates the buffer actuator from a first position to a second position.

10. The firearm as recited in claim 8, wherein the buffer actuator comprises a biasing member that biases the buffer actuator in the first position when the biasing member is in a non-compressed state.

11. The firearm as recited in claim 10, wherein the biasing member comprises a spring.

12. A firearm comprising:

an upper receiver including a bolt, the bolt including:

at least one displaceable biasing member that is configured to bias the bolt in a forward state when the at least one biasing member is in an initial state;

a locking wedge that is configured to bias the at least one displaceable biasing member in the initial state; and a buffer that interfaces with the locking wedge, wherein the at least one displaceable biasing member is configured to be displaced from the initial state to a displaced state when a sufficient amount of force is exerted on the at least one displaceable biasing member from the bolt so that the bolt can transition from the forward state to a backward state, wherein displacement of the bolt causes displacement of the buffer via the locking wedge.

13. The firearm as recited in claim 12, wherein the at least one displaceable biasing member comprises a roller.

14. The firearm as recited in claim 12, wherein the upper receiver is configured as an upper receiver for an AR-15 type firearm.

15. The firearm as recited in claim 12, wherein the at least one displaceable biasing member is designed in a shape of a truncated prolate spheroid.

16. The firearm as recited in claim 15, wherein the at least one displaceable biasing member defines a convex shaped curve that at least substantially matches a bore of the upper receiver portion.

17. The firearm as recited in claim 12, wherein the locking wedge defines a locking wedge angle that allows the at least one displaceable biasing member to be displaced based on a sufficient amount of force being exerted on the bolt.

18. The firearm as recited in claim 12, further comprising a buffer spring, wherein the buffer spring bias the buffer in a forward position when the buffer spring is in a non-compressed state.

19. The firearm as recited in claim 12, further comprising a buffer actuator that is configured to remove a locking force of at least one of the locking wedge or the at least one displaceable biasing member when a sufficient amount of force translates the buffer actuator from a first position to a second position.

20. The firearm as recited in claim 19, wherein the buffer actuator comprises a biasing member that biases the buffer actuator in the first position when the biasing member is in a non-compressed state.

* * * * *